United States Patent [19]

Hori et al.

[11] Patent Number: 4,512,675

[45] Date of Patent: Apr. 23, 1985

[54] SERIAL PRINTER

[75] Inventors: Fumihisa Hori; Tadao Tamukai, both of Tamayama; Mikio Miyajima, Nishine, all of Japan

[73] Assignee: Alps Electric Co., Ltd., Tokyo, Japan

[21] Appl. No.: 499,559

[22] Filed: May 31, 1983

Related U.S. Application Data

[62] Division of Ser. No. 178,891, Aug. 18, 1980, Pat. No. 4,414,893.

[30] Foreign Application Priority Data

Aug. 20, 1979 [JP] Japan ..... 54-105673

[51] Int. Cl.[3] ..... B41J 19/68

[52] U.S. Cl. ..... 400/328; 400/320; 400/332.6; 400/334.3; 101/93.15

[58] Field of Search ..... 101/93.15–93.17; 400/320, 322, 328, 330, 331, 332.6, 334.2, 334.3

[56] References Cited

U.S. PATENT DOCUMENTS

| | | | |
|---|---|---|---|
| 2,375,541 | 5/1945 | Dirkes et al. . | |
| 2,984,328 | 5/1961 | Lambert | 400/331 |
| 3,628,645 | 12/1971 | McFeaters et al. | 101/93.15 |
| 3,739,899 | 6/1973 | Brumbaugh et al. | 197/82 |
| 3,924,725 | 12/1975 | Kuhn et al. | 400/328 |
| 3,972,280 | 8/1976 | Swatik et al. | 101/93.16 |
| 4,218,151 | 8/1980 | Kondur, Jr. | 400/328 |
| 4,244,291 | 1/1981 | Kodaira et al. | 101/93.17 |
| 4,310,256 | 1/1982 | Inoue | 101/93.17 |
| 4,383,773 | 5/1983 | Arai | 101/93.17 |

FOREIGN PATENT DOCUMENTS

| | | |
|---|---|---|
| 52-46930 | 4/1977 | Japan . |
| 53-56514 | 5/1978 | Japan . |
| 54-68325 | 6/1979 | Japan . |

*Primary Examiner*—William Pieprz

*Attorney, Agent, or Firm*—Guy W. Shoup; Gerard F. Dunne

[57] ABSTRACT

A serial printer suitable for use in desk-top calculators or the like. The serial printer has a rotary shaft rotatable together with two type wheels. The power supply to the rotary shaft is made by a motor which operates continuously only in one rotational direction through a first clutch. A second clutch is provided to make a selective power transmission between the rotary shaft and the member for actuating the hammer, as well as the member for causing the carrying operation. The states of the first and the second clutches are controlled by a change-over arm which in accordance with the operation instruction given by an operation instruction coil, such that these clutches are alternatingly turned on and off to make various operations such as printing, column shift, paper feeding and so forth.

7 Claims, 12 Drawing Figures

SERIAL PRINTER

This application is a division of our copending application Ser. No. 178,891 filed Aug. 18, 1980, now U.S. Pat. No. 4,414,893, dated Nov. 15, 1983.

BACKGROUND OF THE INVENTION

The present invention relates to a typing mechanism of a serial printer suitable for use for creating a display for small desk-top calculators or measuring instruments.

Desk-top calculators and measuring instruments having display devices for digitally displaying the calculation or measuring result are known. Recently, there have been proposed desk-top calculators and measuring instruments having a recording function in which the calculation or measuring results are printed on a record paper by means of a serial printer. The serial printer of this kind preferably has a compact construction because only a small space is typically available for the installation of such a printer. It is, however, extremely difficult to reduce the size of the serial printer because it has various complicated mechanisms such as the rotary drive mechanism for the type wheel, the mechanism for effecting column shift of the carriage carrying the type wheel, the hammer driving mechanism for effecting the typing, the paper feed mechanism and so forth.

Current desk-top calculators also display various arithmetic operation functions so that it is required to print function symbols of a number which is often as large as the number of numerals 0 (zero) to 9 (nine) which may be printed. If the numerals and the function symbols are accomodated by a common type wheel, the diameter of the type wheel is increased undesirably to increase the size of the printer as a whole, which makes it difficult to install the printer in the space available in the calculator or the like.

In order to obviate this problem, a printer has been proposed in which separate type wheels are used for the function symbols and numeral symbols, and only the type wheel for the numeral symbols is arranged to move for a shift in column position along a line of type. As will be seen from Japanese Patent Laid-open No. 46930/1977, this proposed printer has separate hammer members associated with respective type wheels and adapted to operate independently of each other, so that a complicated mechanism is required for driving the two hammer members by a single driving source.

Also a serial printer in which the two type wheels are selectively hit by a single hammer member to eliminate the mechanism for the selection between two type wheels has been proposed. This improved serial printer is disclosed in Japanese Patent Laid-open No. 56514/1978.

The serial printers proposed in Japanese Patent Laid-open Nos. 46930/1977 and 56514/1978 are suitable for mounting in desk-top calculators or the like because of their reduced size and weight. These serial printers, however, still involve problems of high cost and large space of the driving source which typically includes a pulse motor for driving the type wheels rotably, a solenoid of a comparatively large size for effecting the column shift of the type wheel and the driving of the hammer member, and another solenoid of comparatively large size for the record paper and release of the carriage to return it to its initial position.

Meanwhile, Japanese Patent Laid-open No. 68325/1979 described a serial printer having two type wheels, in which the selection of type, printing, column shift, paper feed and other necessary operations are made by a single motor. In this serial printer, however, there is a practical limit to which the printing speed may be increased because the motor has to be reversible. In addition, the reversible motor is comparatively expensive and requires a complicated control. Furthermore, a complicated mechanism is required for the selection and holding of two type wheels independently of each other.

SUMMARY OF THE INVENTION

It is, therefore, a major object of the present invention to overcome the above-described problems of the prior art.

Namely, it is an object of the invention to provide a small serial printer of light weight.

Another object of the invention is to provide a serial printer having a driving source with a reduced number or parts and requiring a reduced space for installation so as to be suitably mounted in small-sized and handy desk-top calculators.

Still another object of the invention is to increase the printing speed of a serial printer by using a motor continuously operating unidirectionally and transmitting power as required to desired shafts through a clutch mechanism.

A further object of the invention is to provide a serial printer in which the number of rotary shafts is reduced as much as possible to reduce the size of the printer as a whole.

A still further object of the invention is to simplify the construction and to reduce the size of the serial printer by mounting serial parts on the same rotary shafts to make an efficient use of these shafts.

According to the present invention, a single motor is provided to rotate two type wheels and power the movement of a hammer element. The motor is used to rotate a shaft providing power selectively to both the two type wheels and the hammer.

The above and other objects, as well as advantageous features of the invention will become clear from the following description of the preferred embodiments taken in conjunction with the accompanying drawings.

DESCRIPTION OF THE PREFERRED EMBODIMENT

Figure 1:
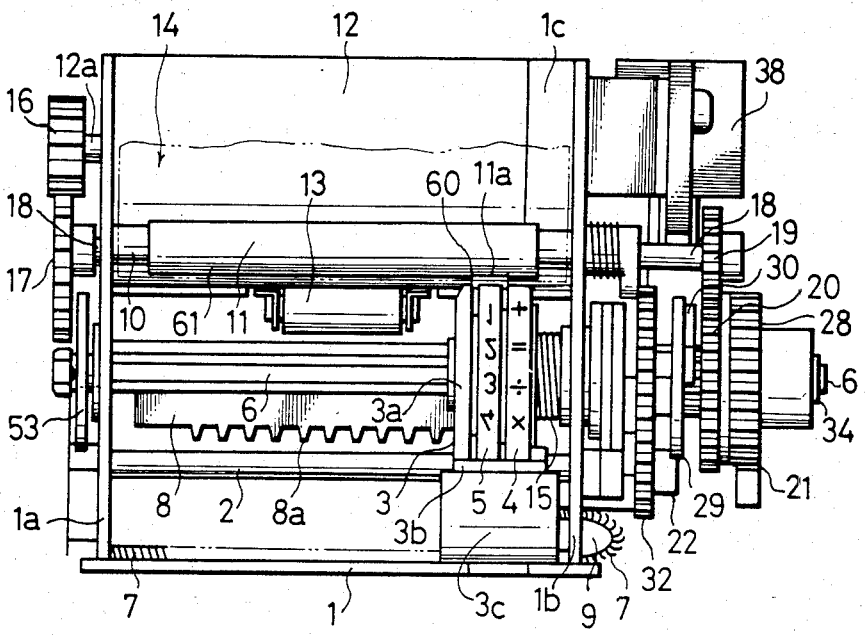
FIG. 1 is a plan view of a serial printer constructed in accordance with an embodiment of the invention.

Referring first to FIG. 1 which is a plan view of a serial printer constructed in accordance with an embodiment of the invention, side panels 1*a*, and 1*b* provided at respective sides of a frame panel 1 are adapted to support a paper guide 1*c*. A rotatable rail 2 is extended between the side panels 1*a*, and 1*b*. A carriage 3 is movable along the rail 2 in the left and right directions, i.e. in the direction of a line to be printed. A reference numeral 4 denotes a type wheel carrying the types for the function symbols, while another type wheel carrying numeral symbols is designated by a reference numeral 5. These type wheels 4 and 5 are carried by the carriage 3. The type wheels are splined to a rotary shaft 6 extending through these type wheels so as to be rotatively driven by the rotary shaft 6. The type wheel 4 is movable in the axial direction of the rotary shaft 6 relatively to the latter but only by a distance corresponding to one arithmetic place to the left as viewed in FIG. 1; while the type wheel 5 is movable to the leftmost position along the rotary shaft 6. The carriage 3 is urged to an initial position shown in FIG. 1 by a tension spring 7 which is stretched between the side panel 1*a* and the carriage 3.

The column shift of the carriage in the direction of printing is made by means of a rack 8 having rack teeth 8*a*, as will be set forth more fully below.

A reference numeral 9 designates a guide member adapted for guiding the tension spring 7 and attached to the side panel 1*b*. A reference numeral 11 designates a printing hammer carried by a hammer shaft 10 supported by the side panels 1*a* and, 1*b*. The hammer 11 pivots as the hammer shaft 10 rotates.

A notch 11*a* for preventing typing with either one of the type wheels is formed in the striking surface of the hammer 11. A reference numeral 60 denotes a mask located in the notch 11*a*. Reference numeral 12 denotes a drive motor, 13 denotes an auxiliary roller for effecting paper feed, 14 denotes a record paper placed between the printing hammer 11 and the type wheels 4, and 5, 3*a* denotes a carriage arm which supports the type wheel 5, 3*b* denotes an ink roller, 3*c* denotes a cylinder holding the ink roller, 15 denotes a compression spring.

Power source voltage is continuously applied to the drive motor 12 even when the printing operation is suspended, so that the motor shaft 12*a* is always rotating. The torque of the motor shaft is transmitted to the rotary shaft 6 through a clutch mechanism which will be described later in detail. Thus, the rotary shaft 6 and, hence, the type wheels 4, and 5 are rotated continuously. As a printing instruction is given to the printing mechanism to bring the type of the desired function symbol to the printing position, the hammer shaft 10 is rotated to pivot the printing hammer 11 to impact the recording paper 14 against the type wheel 4 to print the desired function symbol. In this state, the type wheel 5 is positioned across from the notched part 11*a* so that the printing of a numeral is not performed because of the mask 60 situated between the recording paper and the type wheel 5.

When the printing on the first arithmetic place is over, the carriage 3 is shifted to the left (carry operation) by the rotation of a carriage drive gear (or cam to be mentioned later) meshing with the teeth 8*a* of the rack 8 and provided under the carriage 3. The type wheel 5 carried by the carriage cam 3*a* is shifted to the second place as a result of the carry operation of the carriage 3, whereas the type wheel 4 follows the movement of the carriage 3 but only to the position opposing the notched part 11*a* of the printing hammer 11, since it is urged to the left by the spring 15. The type wheel 4 is maintained in this position until the carriage 3 is returned after completion of the printing of one line. More specifically, the type wheel 4 is retained by a step formed on the shaft 6, although such step is not shown.

As the carriage 3 is moved to the second arithmetic place and the type of the desired numeral is brought to the printing position, the aforementioned printing operation is made to print the numeral on the record paper at the second arithmetic place.

This printing operation is repeated to complete the printing of one line. Thereafter, the column shift rack 8 is made to pivot in accordance with a blanking instruction, so that the teeth 8*a* of the rack 8 are brought out of engagement with the carriage drive gear of the carriage 3, so that the carriage 3 is returned to the initial position shown in FIG. 1 by the force of the tension spring 7. Thereafter, the paper is fed by a distance corresponding to one pitch of line to complete the printing operation.

The printing mechanism of the serial printer of the invention will be described in detail hereinunder.

A pinion 16 is attached to a motor shaft 12*a* of the drive motor 12, and meshes with an idle gear 17 which is fixed to one end of a shaft 18 rotatably carried by the side panels 1*a*, and 1*b*. The shaft 18 carries at its other end an idle gear 19 meshing with a gear 20 which is loosely mounted on the shaft 6 for free rotation. The rotary shaft 6 incorporates a clutch 21 for transmitting the power of the gear 20 to the rotary shaft 6, as well as a clutch 22 for transmitting the power of the gear 20 to the column shift mechanism and hammer driving mechanism. These clutches will be described in detail in the later part of the specification.

Figure 3:
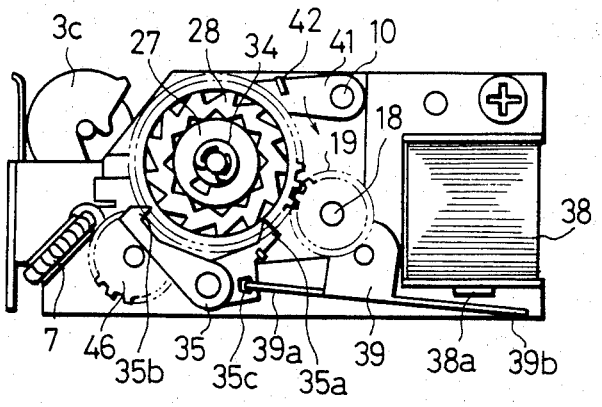
FIG. 3 is a side elevational view of the right side of the serial printer of FIG. 1, showing the idling period thereof.
Figure 2:
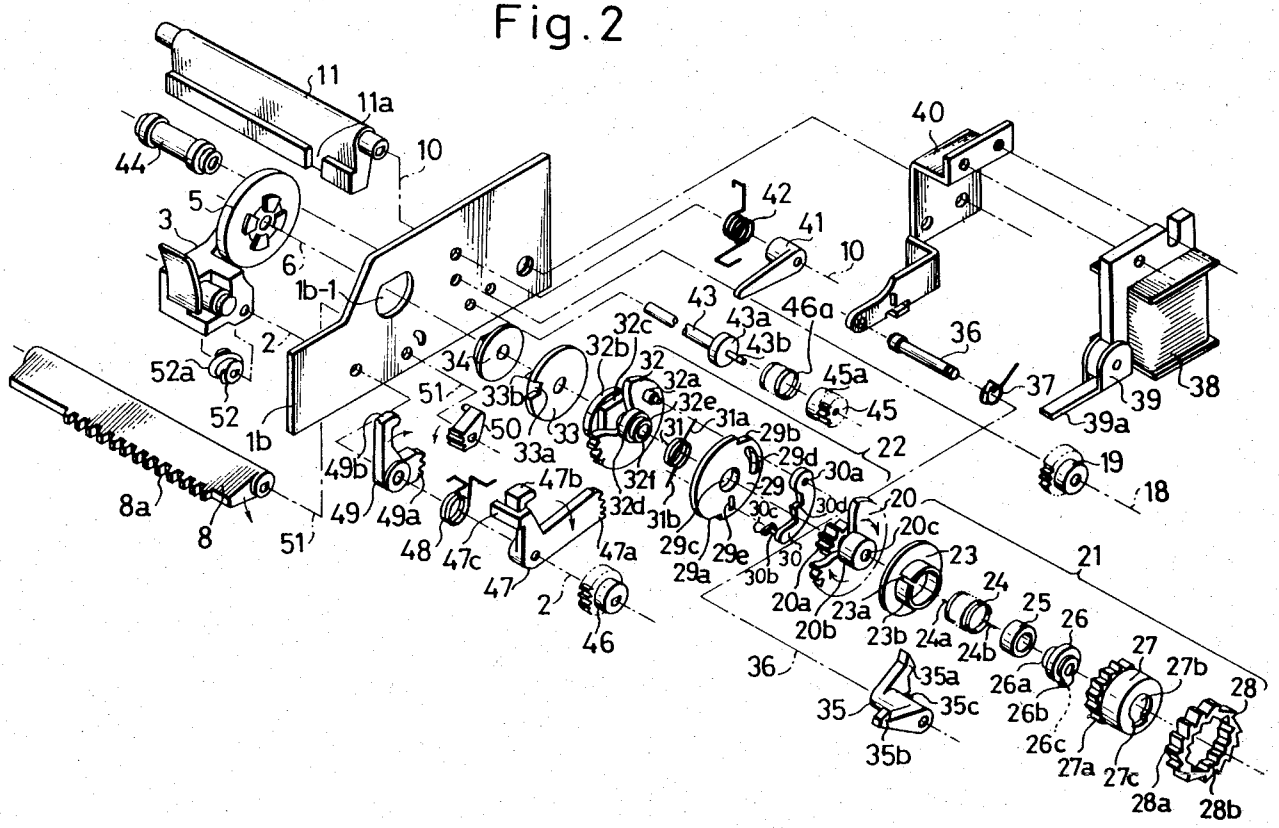
FIG. 2 is an exploded perspective view of the serial printer of FIG. 1.

FIG. 2 is an exploded perspective view of the driving mechanism, while FIG. 3 is a right side elevational view of the same, of the serial printer of this embodiment.

As will be clearly understood from FIG. 2, the gear 20 is provided at its one side with ratchet teeth 20*a* and at its other side with a metallic hub 20*b*. The clutch 21 includes a a collar member 23 provided at its outward side with a retaining sleeve 23*b* and having a slit 23*a*. A coiled spring 24 for a spring clutch is provided at its ends with respective engaging tabs 24*a*, and 24*b*. The coiled spring 24 has an inside diameter somewhat smaller than the outside diameter of the hub 20*b* and an outside diameter which is slightly smaller than the inside diameter of the retaining sleeve 23*b*. A metallic cylinder 25 and a transmission member 26 are forcibly fitted to the rotary shaft 6 for rotation unitarily therewith. The transmission member 26 is provided at its inner side with a connecting portion 26*a* to which the cylinder 25 is press-fitted to rotate unitarily with the transmission member 26. A sector shaped engaging piece 26*b* is formed at the other side of the transmission member. Although not shown, the transmission member 26 is provided with a hole into which the engaging tab 24*b* of the coiled spring 24 is inserted. The approximate position of this hole is designated by the area where the lead line from the numeral 26 touches the transmission member in FIG. 2.

A hollow operation sleeve 27 is provided at its inner end with peripheral teeth 27*a* having 12 ridges. Also, A sector-shaped engaging groove 27*c* for engagement with the sector engaging piece 26*b* and a bore 27*b* for receiving the rotary shaft 6 are formed at the outer side of the operation sleeve 27. The divergence angle of the engaging groove 27*c* is several degrees greater than that of the engaging piece 26*b*.

A reference numeral 28 designates an operation ratchet ring provided on its outer periphery with 13 ratchet teeth 28*a* and on its inner periphery with 12 teeth 28*b* for engagement with the teeth 27*a* of the operation sleeve 27.

Figure 4:
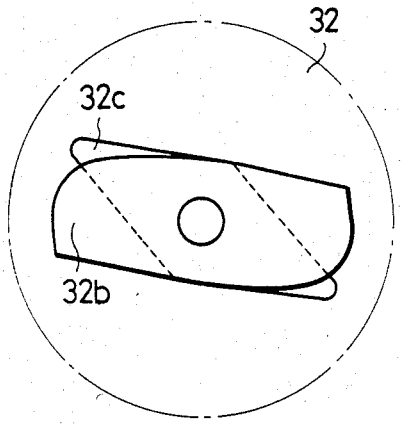
FIG. 4 is a front elevational view showing specifically the shapes of a timing cam and a hammer cam, as well as the positional relationship therebetween of the serial printer of FIG. 1.
Figure 5:
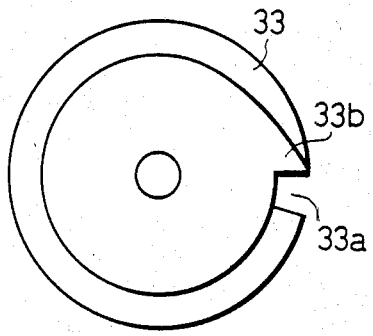
FIG. 5 is a front elevational view showing the shape of a rack resetting cam, as well as the positional relationship between the rack resetting cam and the hammer cam of the serial printer of FIG. 1.

The clutch 22 includes a retainer plate 29 through which the rotary shaft 6 extends. The retainer plate 29 is provided on its periphery with notches 29*a* and 29*b* diametrically opposed to one another and, at its central portion, with a circular bore through which the rotary shaft 6 extends. The retainer plate 29 further has a circumferentially elongated hole 29*d* and a radially elongated hole 29*e*. A ratchet pawl 30 is provided at its one end with a hole 30*a* and at its other end with a guide pin 30*b* extending perpendicular in the inward direction therefrom. A retaining projection 30*c* are formed at the end of the guide pin 30*b*. A pawl 30*d* is formed at the central portion of the ratchet pawl 30. A spiral spring 31 has retaining ends 31*a* and 31*b* at its respective ends. A carrying drive gear 32 is provided at its outer side with a pin 32*a* which rockably or pivotally carries the ratchet pawl 30. A timing cam 32*b* and a hammer cam 32*c* are attached to the inner side of the carrying drive gear 32. The shapes of these cams 32*b* and 32*c*, as well as their positional relationship therebetween are shown in FIG. 4. A reference numeral 33 designates a transmission plate provided at its periphery with a notched groove 33*a*. A rack resetting cam 33*b* is attached to the inner side of the transmission plate 33. The shape of the rack resetting cam 33*b*, as well as the positional relationship between the cam and the groove 33*b*, are shown at FIG. 5. A reference numeral 34 denotes a bearing received by a hole 1*b*-1 formed in the side panel 1*b*.

The assembly on the rotary shaft 6, and the aforementioned clutches 21 and 22, will be described hereinunder.

The transmission plate 33 is press-fitted to the portion of the rotary shaft 6 projecting out from the bearing 34, so as to be rotated unitarily with the rotary shaft 6. Then, the spiral spring 31 is fitted onto the step 32*d* of the carrying drive gear 32, with its one end 31*a* retained by the pin 32*a*. The retaining projection 30*c* of the ratchet pawl 30 is inserted into the elongated hole 29*e* of the retainer plate 29 so as to project from the opposite side of the latter. The ratchet pawl 30 is then rotated slightly to position the guide pin 30*b* loosely within the elongated hole 29*e*. The small step 32*e* of the carrying drive gear 32 is fitted into the central bore 29*c* in the retainer plate 29 incorporating the ratchet pawl 30 in the manner stated above. The pin 32*a* is inserted into the elongated hole 29*d* and the hole 30*a* of the ratchet pawl 30. Thereafter, the other end 31*b* of the spiral spring 31 is retained by the guide pin 30*b* of the ratchet pawl 30. The rotary shaft 6 is inserted into the central bore 32*f* of the carrying drive gear 32 which now incorporates the ratchet pawl 30, retainer plate 29 and the spiral spring 31. Thereafter, the gear is mounted such that the rotary shaft 6 is received by the bore 20*c* of the gear 20, thereby to complete the assembling of the clutch 22.

In the assembled state of the clutch 22, the clutch is engaged and dis-engaged as the ratchet teeth 20*a* and the pawl 30*a* are brought into and out of engagement with each other by the movement of the ratchet pawl 30 toward and away from the ratchet teeth 20*a*. The detail of this operation will be described later in more detail.

After the assembling of the clutch 22, the collar member 23 is inserted onto the hub 20*b* of the gear 20 and the coiled spring 24 is placed into the pawl space gap formed between the hub 20*b* and the retaining sleeve 23*b* of the collar member 23. More specifically, the engaging tab 24*a* of the coiled spring 24 is inserted into the slit 23*a*. On the other hand, the cylinder 25 is rigidly fitted to the connecting portion 26*a* of the transmission member 26 to become integral with the latter. Then, the cylinder 25 is inserted into the coiled spring 24 while pressing the transmission member 26, which now incorporates the cylinder 25, onto the rotary shaft 6 until the hub 20*b* and the cylinder 25 abut each other at their ends in the coiled spring 24. In this state, the engaging tab 24*b* of the coiled spring 24 is received by the hole 26*c* of the transmission member 26. The transmission member 26 is press-fitted to the rotary shaft 6 to rotate unitarily with the latter.

Subsequently, the teeth 28*b* of the operation ratchetring 28 are brought into engagement with the teeth 27*a* of the operation sleeve 27 to unitarize the operation sleeve 27 and the operation ratchetring 28 with each other, and the operation sleeve 27 is fitted around the transmission member 26 and press-fitted into the collar 23. Thereafter, as shown in FIGS. 1 and 3, a split washer is attached to the end of the rotary shaft 6 to hold the operation sleeve 27, thereby to complete the assembling of the clutch 21.

Before explaining the constructions of remainder parts of the serial printer, a description will be made as to the operation of the clutches 21 and 22.

OPERATION OF CLUTCH 21

As stated before, the drive motor 12 is continuously operating in the serial printer of the invention. Therefore, the gear 20 loosely mounted on the rotary shaft 6 is always rotating through the action of the pinion 16, idle gear 17, shaft 18 and the idle gear 19, in the direction indicated by an arrow in FIG. 2. In the "idling period" in which no printing operation is performed, no member engages with the ratchet teeth 28*a* of the operation ratchetring 28, so that it is in the free state. The hub 20*b* of the rotating gear 20 acts to squeeze and compact the coiled spring 24 which in turn tightly grips the cylinder 25 so that the power is transmitted from the gear 20 to the transmission member 26. In consequence, the type wheels 4 and 5 are rotated by the rotary shaft 6 which is fixed to the transmission member 26. At the same time, the operation sleeve 27 to which the operation ratchetring 28 is attached is rotated together with the rotary shaft 6. A desired type of the type wheel is brought to the printing position, a pawl described below is brought into engagement with the ratchet teeth 28*b* to stop the operation sleeve 27, so that the collar member 23 is stopped to loosen the coiled spring of the spring clutch from the hub 20*b* and thereby disconnect the gear 20 from the transmission member 26. The transmission member 26 and the rotary shaft 6 thus stop rotating. In this state, the hub 20*b* idles in the coiled spring 24. Namely, the clutch 21 is dis-engaged.

Briefly, the clutch 21 engages as the operation sleeve 27 takes a free state and is dis-engaged as the operation sleeve 27 is stopped.

OPERATION OF CLUTCH 22

Figure 6:
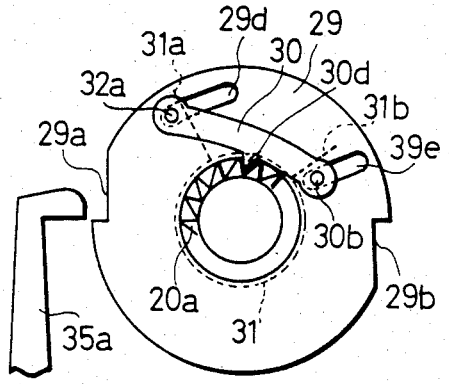
FIGS. 6 and 7 illustrate the operation of clutch 22 of the serial printer of FIG. 1.

In the clutch 22, the ratchet pawl 30 is urged towards the ratchet teeth 20*a* of the gear 20 by means of the spiral spring 31 as shown in FIG. 6. In this state, the pin 32*a* and the guide pin 30*b* are positioned at one end of their respective elongated holes 29*d* and 29*e*.

Figure 7:
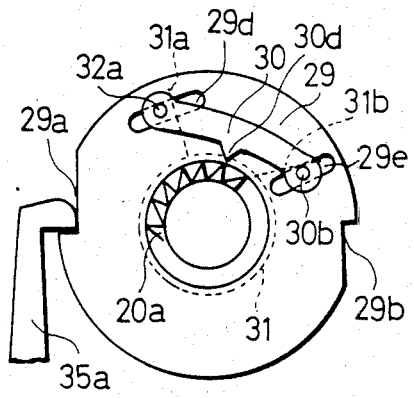

In the idling period in which the printing operation is suspended, a pawl 35*a* of a change-over arm engages the notch 29*a* of the retainer plate 29 to stop the latter from rotating, as will be seen from FIG. 7. Then, as the ratchet teeth 20*a* are rotatably moved, the ratchet teeth 20*a* lift up the pawl 30*d* of the ratchet pawl 30 and the pin 32*a* and the guide pin 30*b* are urged to the other ends of the elongated holes 29*d* and 29*e* overcoming the force of the spiral spring 31, so that the pawl 30*d* of the ratchet pawl 30 is disengaged from the ratchet teeth 20*a*. The ratchet pawl 30 tends to return to the starting position by the force of the spiral spring 31 but this returning motion is checked by the projection 47*b* of a paper feed lever 47 which is pressed against the timing cam 32*b* by the force of the spring 48, as shown in FIG. 2.

As shown in FIG. 6, as the pawl 35*a* is moved away from the notch 29*a*, the ratchet pawl 30 is depressed by the force of the spiral spring 31 to bring the pawl 30*d* into engagement with the ratchet teeth 20*a*. In this state, the ratchet pawl 30 is driven by a rotation of the ratchet teeth 20*a* to rotatively drive the carrying drive gear 32.

Briefly, the clutch 22 dis-engages as the rotation of the retainer plate 29 is stopped, and is engaged as the retainer plate 29 is freed.

Other parts of the serial printer of the invention, which have not been described heretofore, will now be explained.

The change-over arm 35 is rotatably carried by a shaft 36 and is provided with two claws 35*a* and 35*b*, as well as a fitting groove 35*c* for an actuator adapted to actuate the change-over arm 35. The change-over arm 35 is biased counter-clockwise as viewed in FIG. 3, by the action of a spiral spring 37 mounted around the shaft 36. Therefore, in the idling period, the claw 35*a* of the change-over arm 35 engages with either one of the notch 29*a* [or the notch 29*b* of the retainer plate 29 to prevent the latter from rotating.]

An operation instruction coil 38 is provided with an actuator 39 attached to the lower part thereof for free rocking motion. The operation instruction coil 38 is fixed by means of a screw to a supporting bracket 40 which in turn is fixed to the side panel 1*b*. The actuator 39 has one end 39*a* fitting in the groove 35*c* of the change-over arm 35. The other end 39*b* of the actuator 39 opposes the armature 38*a* of the operation instruction coil 38. A hammer lever 41 fits on the hammer shaft 10.

The hammer 11 is urged to its inoperative position, i.e. in the counter-clockwise direction as viewed in FIG. 3, by means of a spiral spring 42. In the assembled state, the the end of the hammer lever 41 is in contact with the surface of the hammer cam 32*c*. A reference numeral 43 designates a paper feed shaft 43 which is pivotally supported by the side panels 1*a* and 1*b*. A paper feed roller 44 is fixed to the paper feed shaft 43. The paper feed shaft 43 carries at its one end a cylinder 43*a* and a pivot pin 43*b* pivotally carrying a paper feed gear 45 having a cylindrical portion 45*a*. The cylindrical portion 45*a* has a diameter equal to that of the cylinder 43*a*. A coiled spring 46*a* is wound round these two members 43*a*, and 45*a* so as to constitute a one-way clutch which acts to transmit power from the gear 45 to the paper feed shaft 43 when the gear 45 is rotated in the paper feeding direction, but this power is not transmitted when the paper feed gear 45 is rotated in the reverse direction. A reference numeral 46 denotes a carrying gear which is press-fitted to the rail 2 which itself rotates and guides the carriage 3 so as to transmit the power to the rail.

In the assembled state, the carrying gear 46 meshes with the carrying drive gear 32 such that it makes one full rotation while the carrying drive gear 32 makes a half rotation. Namely, the gear ratio between the gears 46 and 32 is 2:1. A reference numeral 47 denotes a paper feed lever which loosely fits on the rail 2 and is rockably supported by the rail irrespective of the rotation of the rail 2. The paper feed lever 47 is provided with gear teeth 47*a* for engagement with the paper feed gear 45 formed at the end of one of arms thereof, while, on the end of the other arm, formed is a projection 47*b* contactable with side portions of both of the timing cam 32*b* and the transmission plate 33, and also an engaging piece 47*c*.

Reference numerals 48 and 49 denote, respectively, a spiral spring for biasing the drive lever 47 in the direction of the arrow, and a rack driving lever.

The rack driving lever 49 loosely fits the rail 2 and is pivotally supported by the rail 2 for free rocking motion irrespective of the rotation of the rail 2. The rack drive lever 49 is pressed by the engaging piece 47*c* of the paper feed drive gear 47 to rotate unitarily with the latter. A rack driving gear 49 is provided with teeth 49*a* for engagement with the rack gear 50, as well as a projection 49*b* adapted to contact the rack resetting cam 33*b*.

The rack gear 50 is press-fitted to a rack shaft 51 which rockably and pivotally aupports the rack 8, such that the rack is rotated following the rotation of the rack gear 50. A carriage drive gear 52 embedded in the lower face of the carriage 3 is splined to the rail 2. Therefore, the carriage drive gear rotates together with the rail 2 and is allowed to move in the longitudinal direction of the latter. Cam teeth 52*a* is formed on the outer periphery of the carriage drive gear 52 to make almost two and a half turns therearound.

Figure 8:
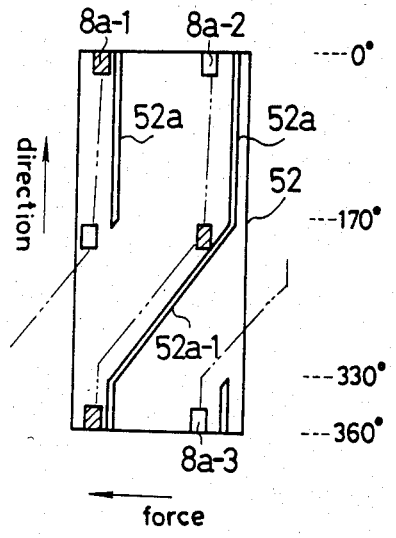
FIG. 8 is an exploded view of a carriage driving gear for the serial printer of FIG. 1.

As will be understood from FIG. 8, the cam surface 52*a* of the carriage drive gear has a first section extending from 0° to 170° around the surface of the drive gear and contacting a preselected tooth 8*a*-1 of the rack and, a second section extending from 170° to 360° over the surface of the drive gear for contacting tooth 8*a*-2 adjacent to the tooth 8*a*-1. As will be clearly seen from this Figure, the carrying operation is made only when the oblique cam surface 52*a*-1 engages the next tooth 8*a*-2, i.e. over the range of between 170° and 330° of the drive gear of this Figure. A numeral 8*a*-3 designates a tooth following the tooth 8*a*-2. Teeth 8*a* shown by hatching are in contact with the cam surface 52*a*, while teeth 8*a* which are not hatched are out of contact with the cam surface 52*a*.

Hereinafter, a detailed description will be made as to the operation of the serial printer of the invention.

Figure 9:
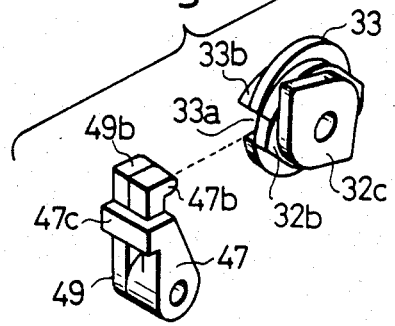
FIGS. 9, 11 and 12 are perspective views of parts of the serial printer of FIG. 1, illustrating the printing, column shifting and carriage returning operations, respectively.
Figure 11:
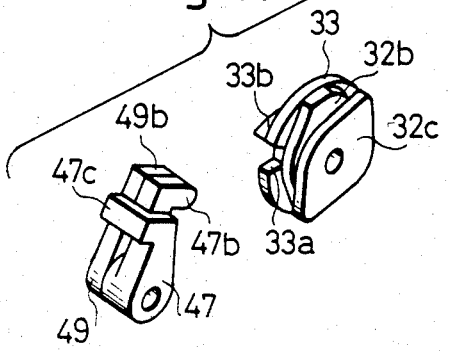

In the idle period shown in FIG. 3 in which the printing operation is suspended, the claw 35*a* of the [change-over arm 35 engages a notch 29*a* or 29*b* of the retainer plate 29 to stop the latter, so that the clutch 22 is disengaged. On the other hand, the clutch 21 is engaged because the claw 35*b* is kept away from the ratchet teeth 28*a*. The rotation of the gear 20 is this transmitted to the rotary shaft 6 to rotate the latter and, hence, the type wheels 4 and 5. Meanwhile, the transmission plate 33 rotates together with the rotary shaft 6 but the projection 47*b* of the paper feed lever is never dropped into the groove 33*a* of the transmission plate 33 because it rides on the cam ridge of the timing cam 32*b* as shown in FIG. 9.

A pulse coder 53 (See FIG. 1) is connected to the rotary shaft 6, so that pulses representing the home positions of the type wheels 4 and 5 and character pulses representing the positions of the types are generated. The type positions of these two type wheels are known from these pulses.

Figure 10:
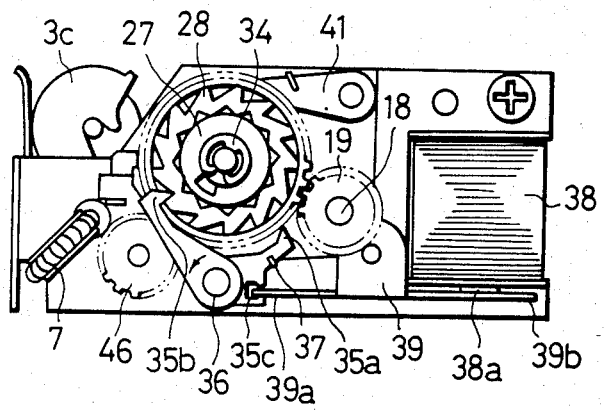
FIG. 10 is a right side elevational view of the serial printer of FIG. 1 in printing operation.

As the type wheels 4 and 5 are rotated to bring the desired function type to the printing position, the operation instruction coil 38 is operated to rotate the actuator 39 in counter-clockwise direction as viewed in FIG. 3. In consequence, the change-over arm 35 is rotated in the counter-clockwise direction to withdraw the claw 35*a* from its engagement with the notch 29*a* or 29*b* of the retainer plate 29 and to bring the claw 35*b* into engagement with the ratchet teeth 28*a* as shown in FIG. 10. As a result, the clutch 21 is dis-engaged without delay to stop the type wheels 4 and 5, while the clutch 22 is engaged to initiate the rotation of the carrying drive gear 32. The hammer lever 41 is rotated by the rotation of the hammer cam 32*c* so that the printing hammer 11 presses the recording paper 14 to the function type to print the desired function symbol. In this state, the type wheel 5 is positioned to confront the notched part 11*a* of the printing hammer 11 so that no printing is made with the numeral types. In ordinary printing operation, the transmission plate 33 is held at such a position that the projection 47*b* of the paper feed drive lever 47 does not oppose the notched groove 33*a*, so that the projection rides on the periphery of the transmission plate 33 and never drops into the groove 33*a*.

The carrying gear 46 engaging with the carrying drive gear 32 makes a half rotation while the latter makes a quarter rotation, so that the carriage drive gear 52 makes a half rotation. However, due to the cam contour of the cam surface 52*a*, the carriage 3 is never shifted in the initial half rotation of the carriage drive gear 52, i.e. during the operation of the printing hammer. In the next quarter rotation of the carrying drive gear 32, the carriage is shifted by one arithmetic place through next half rotation of the carriage drive gear 52. In this state, the hammering operation has been completed and the hammer has been reset in the initial position. As the carrying drive gear 32 makes a half rotation together with the retainer plate 29, printing of one character is finished and the retainer plate 29 with its notch 29*a* or 29*b* engaged by the claw 35*a* of the changeover arm 35 is stopped to dis-engage the clutch 22, while the claw 35*b* is moved away from the ratchet teeth 28*a* to the clutch 21. In consequence, the type wheels 4 and 5 start to rotate again.

This printing operation is repeated until the carriage 3 reaches the position of the highest arithmetic place to complete the printing of one line. The carriage return motion is then commenced.

In the embodiment now described, the outer periphery of the type wheel is divided into 13 sections, namely 12 sections each carrying its own character and one blank section. The arrangement is such that the notched groove 33*a* of the transmission plate is positioned in front of the projection 49*b* of the rack drive gear 49 when the blank section is brought to the printing position.

According to the invention, the carriage return operation is performed in a manner explained hereinunder.

When the blank section is brought to the printing position, the operation instruction coil 38 is energized to the clutch 22 in the same manner as before while disengaging the clutch 21. As a result of energy the clutch 22, the carrying drive gear 32 is rotated to drive the printing hammer 11 but no printing is made on the paper because the printing position is blank. The rotation of the carrying drive gear 32 causes a rotation of the timing cam 32*b* to permit the projection 47*b* of the paper feed drive lever 47 to slip down from the ridge of the timing cam 32*b* into the transmission plate 33, so that the paper feed drive lever 47 is rotated in the direction of arrow in FIG. 2 by the force of the spiral spring 48. In consequence, the engaging piece 47*c* drives the rack drive lever 49 in the direction of arrow so that the rack gear engaging with the teeth 49*a* is rotated. As a result, the rack 8 is rotated to disengage the teeth 8*a* of the rack 8 from the cam surface 52*a* of the carriage drive gear, so that the carriage 3 loses its support to be returned to the initial position by the force of the tension spring 7.

On the other hand, the rotation of the paper feed lever 47 in the direction of the aforementioned arrow causes a rotation of the paper feed gear 45 through the teeth 47*a*. In this state, however, the rotation of the paper feed gear 45 does not cause the rotation of the paper feed roller 44, because in this state, the direction of rotation of the gear 45 corresponds to the idle direction of the paper feed spring clutch. This rotation of the paper feed drive lever 47 is the movement to a stand-by position for the next paper feeding operation.

As the carrying drive gear 32 rotates further, the timing cam 32*b* gradually lifts the drive lever 47 to the initial position. In this case, the gear 45 rotates in the power transmitting direction of the spring clutch so that the paper feed roller 44 is rotated to feed the recording paper pinched between the paper feed roller 44 and the paper feed auxiliary roller 13 by a distance corresponding one pitch of lines.

Figure 12:
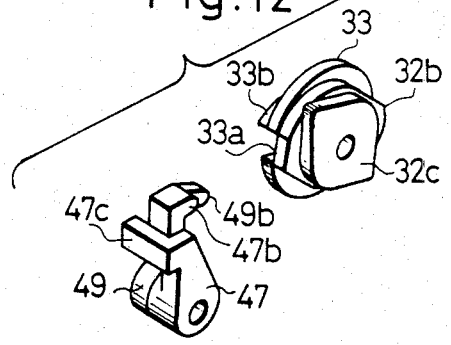

After a half rotation of the drive gear 22, the claw 35*a* of the change-over arm 35 comes again into engagement with the notch 29*a* or 29*b* of the retainer plate 29 and the claw 30*d* is moved away from the ratchet 20*a* to dis-engage the clutch 22. The clutch 21 is engaged as the claw 35*b* leaves the ratchet teeth 28*b*, so that the rotary shaft 6 starts to rotate. Consequently, the transmission plate 33 is rotated to cause the rack resetting cam 33*b* to push up the projection 49*b* which has been in the rotated position as shown in FIG. 12, thereby to rotate the rack driving gear 49 in the direction opposite to the direction of arrow in FIG. 2. In consequence, the rack 8 is rotated to bring the teeth 8*a* into engagement with the cam surface 52*a* of the carriage drive gear 52 to complete one line of printing operation to recover the idling state.

As will be realized from the foregoing description, in the serial printer of the invention, it is essential that the types of the type wheel are stopped correctly at the printing position when the claw 35*b* is engaged and stopped by the ratchet teeth 28*a*. This, however, is extremely difficult to achieve due to errors incurred in the course of production and assembling. It is, therefore, necessary to effect a readjustment of the position by suitable means.

To cope with this demand, according to the invention, the number of the ratchet teeth 28*a* constituting the outer teeth of the operation ratcheting 28 of the clutch 21 is selected to be equal to that of the number of typing positions, i.e. 13, while the numeral teeth 28*b* constituting the internal teeth is selected to be 12. This arrangement permits, in fitting the operation ratchet 28 into the teeth 27*a* of the operation sleeve 27, an adjustment of type position by an angle of 2.3°, i.e. 360°/13-360°/12, by offsetting the teeth by one pitch. For the same reason, if a printing failure is caused by misalignment of the type position, a correct printing position can be recovered by effecting the readjustment of the operation ratchet 28 in relation to the operation sleeve 27.

The clutch 21, which is a spring clutch making use of a squeezing force of a spring 24, permits the rotary shaft 6 to rotate slightly after stopping of the operation sleeve 27. Namely, the rotary shaft 6 is allowed to rotate till the spring releases the cylinder 20*b*, by a certain angle which in this case is referred to as the release angle. In order to absorb this release angle, according to the invention, the divergence angle of the groove 27*c* is selected to be slightly greater than that of the engaging piece 26*b*, thereby to provide a margin for allowing slight rotation of the rotary shaft 6 after a perfect stopping of the operation sleeve 27. The difference of angle, however, is as small as several degrees.

In the serial printer of the invention, the carriage return operation and the paper feed operation are performed in relation to the printing operation with the blank position of the type wheel. In some cases, however, it is necessary to make a blank printing, i.e. to provide a vacant or blank space in the printed character line. In such a case, two blank sections are provided on the type wheel, one is for the initiation of the carriage return and paper feed operations, while the other being used for the aforementioned blank printing.

As has been described, in the serial printer of the invention, all operations necessary for the printing are performed by a single motor which operates only in one direction, so that the space occupied by the drive source is remarkably reduced to contribute to the reduction of the size of the serial printer as a whole. In addition, since the operations such as printing, column shift and so forth are made by the force which is derived as necessitated through two clutches from the motor shaft of the drive motor which operates continuously in one rotation direction, the printing speed is much increased as compared with the conventional serial printer incorporating two indepndent motors or a single reversible motor.

The reduction of the size of the serial printer as a whole is very much assisted also by the simplified construction which is realized by mounting of the first and second clutches in the rotary shaft for rotatively driving the type wheel.

In addition, the operation instruction system is very much simplified because various instructions necessary for the operation of the serial printer is given by the sole operation instruction coil.

What is claimed is:

1. A printer including a carriage carrying at least one type wheel having a plurality of type elements around its circumference; means for moving said carriage along a line to be printed against a force urging said carriage to its initial position; said moving means including a gear element carried rotatably by said carriage for movement therewith along a line to be printed and having a cam surface, said cam surface including a first section extending substantially over half the circumference of said gear element and extending along the direction of rotation thereof, and a second section extending obliquely to the direction of rotation, a rack positioned along the path of movement of said carriage to mesh with said cam surface to move said carriage along said rack, and means for rotating said gear; and means for rotating said rack out of engagement with said gear to allow said carriage to return to its initial position.

2. A printer including a carriage carrying at least one type wheel having a plurality of type elements around respective areas of its circumference; means including a rotatable shaft held to said type wheel for positioning a selected area of said type wheel in a printing position along a line to be printed; impact means including a printing hammer located along said line to be printed for pressing a record member between said type wheel and said printing hammer; means connected to said carriage for moving said carriage along said printing line and holding said type wheel in proper longitudinal position thereacross, said carriage moving means including a rotatable element held rotatably to said carriage for movement therewith along a line to be printed and having a cam surface extending outwardly, said cam surface including a first section extending substantially over half the circumference of said rotatable element and extending along the direction of rotation thereof, and a second section extending obliquely to the direction of rotation of said rotatable element, and a rack extending along said line to be printed and having teeth adapted to engage said cam surface for moving said carriage along said rack as said rotatable element is rotated, the pitch of the teeth of said rack being equal to the space desired between characters along said printing line; and return means connected to said carriage for returning said type wheel to its initial position, said return means including means for rotating said rack out of engagement with said cam surface.

3. A serial printer as recited in claim 2, said rotatable element being fixed to a second shaft rotated by actuation of said impact means.

4. A serial printer as recited in claim 2, said return means including a transmission cam rotated by said shaft, a cam adapted to rotate in conjunction with actuation of said hammer moving means, and a release lever actuatd by said cams to rotate said rack.

5. A printer as recited in claim 4, including means associated with said release lever for feeding said record member upon completion of a printing line, said paper feeding means including a feed lever adapted to rotate upon actuation of said release lever.

6. A printer including a carriage adapted to carry at least one type wheel having a plurality of type elements around its circumference; means for moving said carriage along a line to be printed against a force urging said carriage to its initial position; said moving means including a rotatable element carried rotatably by said carriage for movement therewith along a line to be printed and having a cam surface extending outwardly, said cam surface including a first section extending substantially over half the circumference of said rotatable element and extending along the direction of rotation thereof, and a second section extending obliquely to the direction of rotation of said rotatable element, a rack positioned along the path of movement of said carriage and having teeth adapted to engage said cam surface to move said carriage along said rack, and means for rotating said rotatable element; and means for rotating said rack out of engagement with said cam surface to allow said carriage to return to its initial position.

7. A serial printer as recited in claim 6, the pitch of the teeth of said rack being equal to the space between characters along said printing line.

* * * * *